US006489714B2

(12) United States Patent
Kim

(10) Patent No.: US 6,489,714 B2
(45) Date of Patent: Dec. 3, 2002

(54) COLOR SELECTING APPARATUS FOR CATHODE-RAY TUBE

(75) Inventor: Hoo-Deuk Kim, Pusan (KR)

(73) Assignee: Samsung SDI Co., Ltd., Suwon (KR)

( * ) Notice: Subject to any disclaimer, the term of this patent is extended or adjusted under 35 U.S.C. 154(b) by 163 days.

(21) Appl. No.: 09/774,237

(22) Filed: Jan. 31, 2001

(65) Prior Publication Data

US 2001/0020814 A1 Sep. 13, 2001

(30) Foreign Application Priority Data

Jan. 31, 2000 (KR) ..... 2000-4680

(51) Int. Cl.[7] ..... H01J 29/07
(52) U.S. Cl. ..... 313/407; 313/404
(58) Field of Search ..... 313/407, 404, 313/402, 403

(56) References Cited

U.S. PATENT DOCUMENTS

| | | | | | |
|---|---|---|---|---|---|
| 5,167,577 | A | | 12/1992 | Teramoto et al. | 445/47 |
| 5,214,349 | A | * | 5/1993 | Sakata et al. | 313/407 |
| 5,289,080 | A | | 2/1994 | Park | 313/402 |
| 5,391,957 | A | * | 2/1995 | Fendley | 313/402 |
| 5,451,833 | A | | 9/1995 | Tong | 313/402 |
| 5,484,074 | A | | 1/1996 | Deibler et al. | 216/12 |
| 5,682,021 | A | | 10/1997 | Jeon et al. | 181/166 |
| 5,917,273 | A | | 6/1999 | Watanabe et al. | 313/402 |
| 6,025,676 | A | | 2/2000 | Ohama et al. | 313/477 |
| 6,046,535 | A | | 4/2000 | Jung | 313/402 |
| 6,104,132 | A | | 8/2000 | Nose et al. | 313/402 |
| 6,111,347 | A | * | 8/2000 | Kwak | 313/407 X |
| 6,133,682 | A | | 10/2000 | Murai et al. | 313/403 |

* cited by examiner

*Primary Examiner*—Ashok Patel
(74) *Attorney, Agent, or Firm*—Robert E. Bushnell, Esq.

(57) ABSTRACT

A color selecting apparatus for a cathode-ray tube including a frame, and a mask supported in the frame with tension along a minor axis, where the mask having a rectangular hole part formed with a plurality of electron beam-passing apertures, a non-hole part surrounding the hole part, and a pair of vibration attenuating members attached at both ends of the surface of the non-hole part, facing each other along a major axis, for attenuating vibration waves which transmit along the major axis. The vibration attenuating members are made of a metal having a greater mass than the non-hole part, and attached by spot-welding so that they are away from the non-hole part by a predetermined gap at every portion except the welding points. Therefore, the vibration attenuating members serve as a damper to attenuate vibrations which are transmit in the major direction, particularly vibrations generated by the speakers.

10 Claims, 3 Drawing Sheets

COLOR SELECTING APPARATUS FOR CATHODE-RAY TUBE

CLAIM OF PRIORITY

This application makes reference to, incorporates the same herein, and claims all benefits accruing under 35 U.S.C. § 119 from an application entitled A Colour Selecting Apparatus for Cathode Ray Tube earlier filed in the Korean Industrial Property Office on Jan. 31, 2000, and there duly assigned Ser. No. 2000-4680 by that Office.

BACKGROUND OF THE INVENTION

1. Field of the Invention

The present invention relates to a color selecting apparatus for a cathode-ray tube, and more particularly, to a color selecting apparatus having a tensed mask, which includes a pair of vibration attenuating members for preventing the so-called howling phenomenon due to vibrations of the mask.

2. Description of the Background Art

In general, a cathode-ray tube is used for displaying an image by emitting light on a phosphor screen with electron beams generated from an electron gun assembly. The cathode-ray tube includes a shadow mask as a color selecting electrode for separating three electron beams to corresponding red (R), green (G) and blue (B) phosphor layers on the screen.

The shadow mask is made by forming a plurality of beam-passing apertures on a thin aluminium-killed (AK) steel or an INVAR steel by the well-known photolithography process. Killed steel is deoxidized by the addition of deoxidizing elements such as aluminum in the ladle prior to ingot casting to form aluminum-killed steel. INVAR steel is a trademark for a steel alloy containing approximately 36% to 50% nickel (Ni) and the rest iron (Fe). INVAR steel has a low coefficient of thermal expansion.

The shadow mask is apt to be depressed due to an external impact since the shadow mask is formed in an extremely thin thickness over a relatively wide area with beam-passing apertures, decreasing the strength thereof. Further, the so-called doming phenomenon, which refers to the expansion toward the phosphor screen due to the continuous radiation of electron beams, may occur in the shadow mask.

If the shadow mask is deformed or the doming phenomenon occurs as described above, the positions of the beam-passing apertures are altered so that precise color separation of the electron beams is disturbed, and thereby the degree of purity of the images is degraded.

Therefore, in order to overcome the above defects and to meet the tendencies toward the super flat screen, a tensed mask that is supported in a frame with tension force has been suggested.

A tensed mask includes a hole part formed with a plurality of beam-passing apertures, and a non-hole part positioned to surround four edges of the hole part. The tensed mask is spot-welded on the frame and supported by the frame with tension applied on the mask. The tensed mask constructed as above is especially appropriate to a flat screen and has advantages in that thermal expansion is restrained by the tension force and accordingly the doming phenomenon is effectively prevented.

However, the tensed mask is sensitive to vibration and has disadvantages in that vibration is apt to be generated due to not only external vibration energy, but also an external energy applied by the complex influence exerted by the spot-welding state with the frame, the thickness of the mask itself, and the alignment of the beam-passing apertures 1*a*, etc. Such vibrations continue for a long period, for example about 10 minutes, due to the influence of sound waves coming out from the speakers.

The phenomenon that degrades the quality of the images due to the long-term vibration of the tensed mask caused by the external energy is the so-called howling phenomenon. The howling phenomenon is generated at both right and left sides of the tensed mask, that are near the speakers, and generally disposed at both sides of the screen, producing sounds.

The howling phenomenon is usually generated in one part of a tensed mask positioned approximately 5 millimeters within both the right and left edges of the hole part, degrading the purity of colors at both right and left ends of the screen.

Exemplars of the art are U.S. Pat. No. 5,167,557 issued to Teramoto et al. discloses Method for Manufacturing a Shadow Mask, U.S. Pat. No. 5,484,074 issued to Deibler et al. discloses Method for Manufacturing a Shadow Mask, U.S. Pat. No. 5,451,833 issued to Tong discloses Shadow Mask Damping for Color CRT, U.S. Pat. No. 6,133,682 issued to Murai et al. discloses Color Cathode Ray Tube Having Shadow Mask with Prescribed Bridge Widths, U.S. Pat. No. 6,104,132 issued to Nose et al. discloses Color Cathode Ray Tube, U.S. Pat. No. 6,046,535 issued to Jung et al. discloses Shadow Mask Frame Assembly for a Cathode Ray Tube, U.S. Pat. No. 6,025,676 issued to Ohama et al discloses Cathode Ray Tube Having Improved Curvature Characteristics and Method of Fabrication Thereof, U.S. Pat. No. 5,917,273 issued to Watanabe et al. discloses Color Cathode-Ray Tube Including a Shadow Mask having Holes Arranged with a Monotonically Non-Decreasing Arrangement Pitch, U.S. Pat. No. 5,682,021 issued to Jeon et al. discloses Howling Phenomena Removing Apparatus for Video Display Appliances, and U.S. Pat. No. 5,289,080 issued to Park discloses Mask Frame Damper for Color Cathode Ray Tubes.

SUMMARY OF THE INVENTION

It is therefore an object of the present invention to provide a color selecting apparatus for a cathode-ray tube that is capable of preventing the so-called howling phenomenon by attenuating vibrations applied to a tensed mask, especially vibrations generated by speakers.

It is another object to have a strong frame structure surrounding a mask in an electron beam apparatus.

It is yet another object to have an electron beam apparatus that reduces the howling phenomenon.

It is still yet another object to have a cathode-ray tube that can avoid the howling phenomenon and still be easily manufactured without heavily increasing manufacturing costs.

In order to achieve the above objects, the color selecting apparatus includes a frame, and a mask supported in the frame with tension along a minor axis, where the mask has a rectangular hole part formed with a plurality of electron beam-passing apertures, a non-hole part positioned surrounding the hole part, and a pair of vibration attenuating members attached at both ends of a surface of the non-hole part, facing each other along a major axis, for attenuating vibration waves that are transmitted on the major axis.

The vibration attenuating members are made of a metal having a greater mass than the non-hole part, and are attached by spot-welding so that they are away from the non-hole part by a predetermined gap in every portion except the welding points. Accordingly, the vibration attenuating members serve as dampers to attenuate vibrations which are transmitted in the major direction, particularly vibrations generated by the speakers, that are apt to cause the howling phenomenon.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
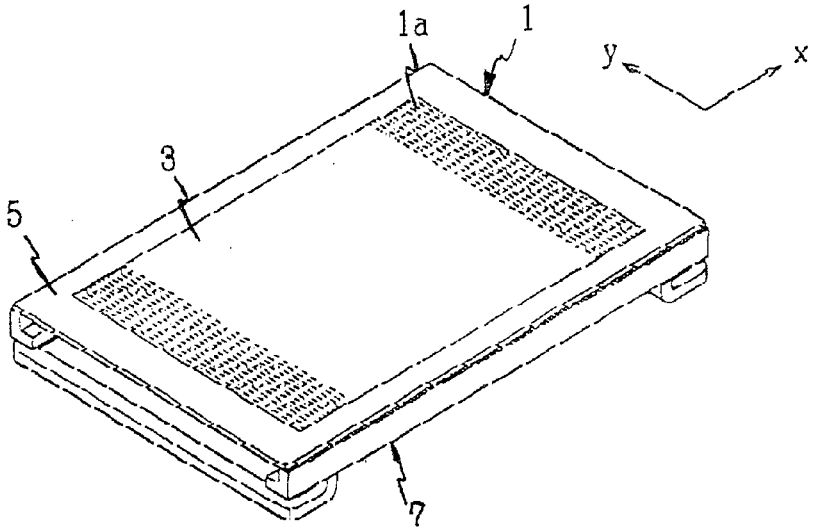
FIG. 1 is a perspective view of a color selecting apparatus.

Turning now to the drawings, as seen in FIG. 1, a color selecting apparatus has a tensed mask 1 and a frame 7 for supporting the mask 1. The tensed mask 1 includes a hole part 3 formed with a plurality of beam-passing apertures 1*a*, and a non-hole part 5 positioned to surround four edges of the hole part 3, which is spot-welded on the frame 7 and supported by the frame 7 with tension applied on the y-axis.

The tensed mask 1 constructed as above is especially appropriate to a flat screen and has advantages in that thermal expansion is restrained by the tension force and accordingly the doming phenomenon is effectively prevented. However, the tensed mask 1 is sensitive to vibration and has disadvantages in that vibration is apt to be generated due to not only external vibration energy, but also an external energy applied by the complex influence exerted by the spot-welding state with the frame 7, the thickness of the mask 1 itself, and the alignment of the beam-passing apertures 1*a*, etc. Such vibrations continue for a long period, for example about 10 minutes, due to the influence of sound waves coming out from speakers.

The phenomenon that degrades the quality of the images due to the long-term vibration of the tensed mask 1 caused by the external energy is the so-called howling phenomenon. The howling phenomenon is generated at both right and left sides of the tensed mask 1, which is near the speakers producing sounds that are generally disposed at both sides of the screen.

Figure 2:
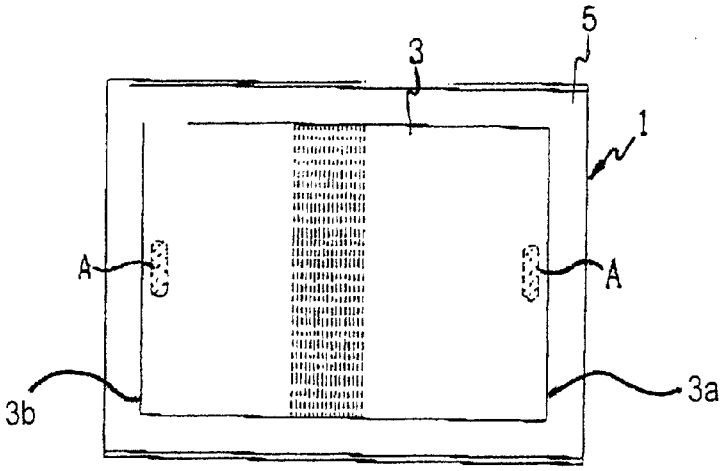
FIG. 2 is a plane view of the color selecting apparatus shown in FIG. 1.

As shown in FIG. 2, the howling phenomenon is usually generated in parts A positioned approximately 5 millimeters within both the right and left edges 3*a* and 3*b* of the hole part 3, degrading the purity of colors at both right and left ends of the screen.

Figure 3:
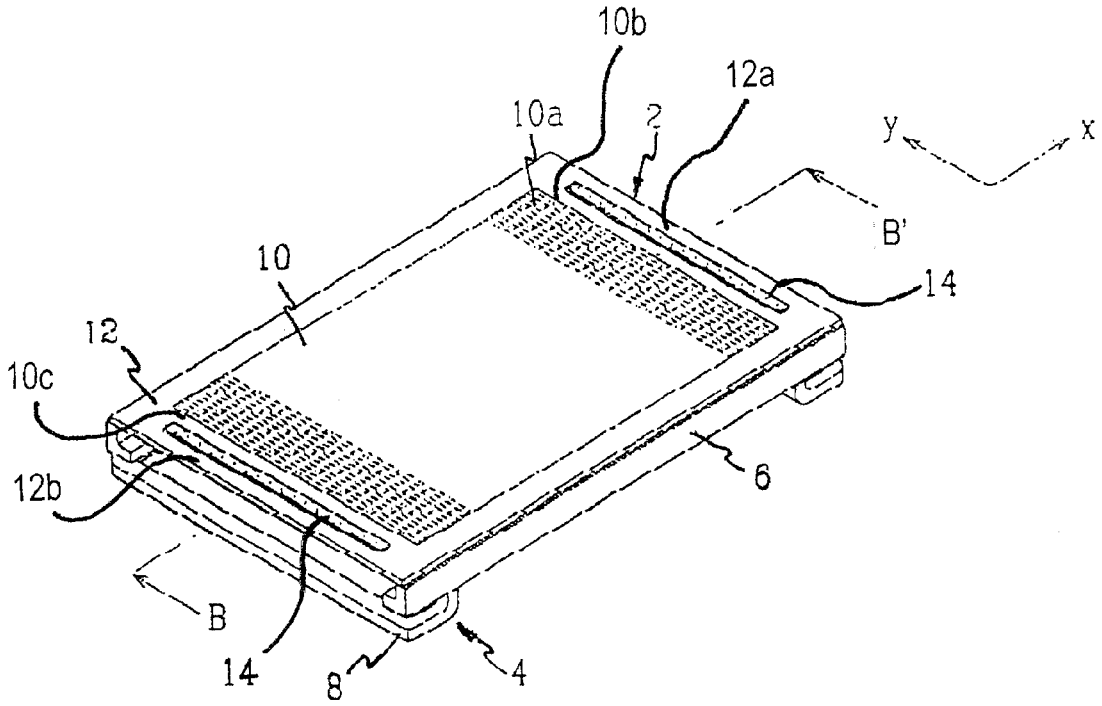
FIG. 3 is a perspective view of a color selecting apparatus according to the present invention.
Figure 4:
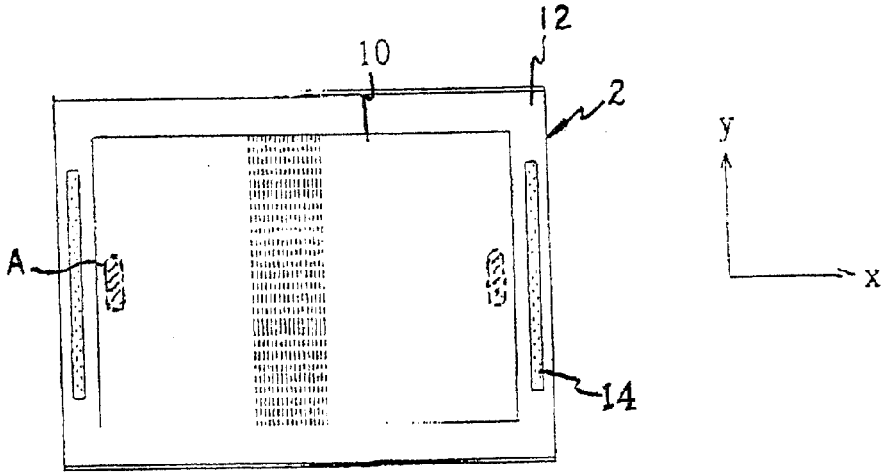
FIG. 4 is a plane view of the color selecting apparatus shown in FIG. 3.

As shown in FIGS. 3 and 4, a color selecting apparatus according to a preferred embodiment of the present invention includes a mask 2 as a color selecting electrode, and a frame 4 for supporting the mask 2 in a cathode-ray tube. The frame 4 includes a pair of supporting members 6 disposed facing each other in the direction of a minor axis (y-axis) of the mask 2, and a pair of tension members 8 for connecting the supporting members 6 and disposed facing each other in the direction of a major axis (x-axis) of the mask 2.

The mask 2 is attached to the supporting members 6 with tension force along the minor axis (y-axis). Thus, the tension members 8 of the frame substantially bear up the tension force applied to the supporting members 6 to not allow the tensed mask 2 to deform. In more detail, the mask 2 includes a rectangular hole part 10 formed with a plurality of beam-passing apertures 10*a*, a non-hole part 12 positioned around the hole part 10 surrounding four peripheral portions of the hole part 10, and a pair of vibration attenuating members 14 provided at a surface of the non-hole part 12.

The vibration attenuating members 14 are disposed at both right and left portions 12*a* and 12*b* of the non-hole part 12 facing each other in the major axis (x-axis), which are near the speakers (not shown). Thus, the vibration attenuating members 14 are for attenuating vibrations that are transmitted in the major axis direction (x-axis), particularly, vibrations generated by the speakers.

For this purpose, the vibration attenuating members 14 are made of a metal having a greater density than the material used to make the hole part 10 and the non-hole part 12. For example, If the hole part 10 and the non-hole part 12 are made of an aluminum-killed (AK) steel or an INVAR steel, the vibration attenuating members 14 are then made of a metal having a greater density than aluminum-killed (AK) steel or INVAR steel. In particular, the vibration attenuating members 14 are made of a nonmagnetic material which is different from the non-hole part 10 so as not to influence an electron beam path. For example, the vibration attenuating members 14 are made of a thin stainless steel.

The vibration attenuating members 14 made of the above material are specifically formed in the shape of a rod, and disposed in parallel with the right and left ends 12*a* and 12*b* of the non-hole part 12, which is along the minor axis direction (y-axis).

Moreover, the vibration attenuating members 14 are made with a length equal to or smaller than the length of the right and left sides 10*b* and 10*c* of the hole part 10 which faces the vibration attenuating members 14. As another embodiment, there is no difference if the length is corresponding to a part A (as shown by a dotted line encompassing part A) in the hole part 10 where the howling is mainly generated.

Figure 5:
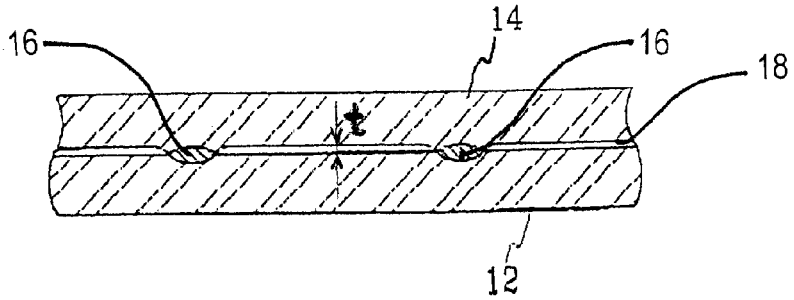
FIG. 5 is a cross-sectional view taken along a line B–B' of FIG. 3.

The vibration attenuating members 14, as above, are attached to the non-hole part 12 by spot-welding after applying tension to the mask 2. Thus, as shown in FIG. 5, a uniform gap 18 of a length "t" is formed between the vibration attenuating members 14 and the non-hole part 12, except at the welding points 16.

According to the above construction, as the vibration attenuating members 14 have a greater density than the non-hole part 12 and maintain a uniform gap 18 of a length "t" between the non-hole part 12 except at the welding points, if the vibrations are transmitted to the tensed mask 2 in the major direction, the vibration attenuating members 14 serve as a damper for compensating or absorbing the vibration or reducing the vibration by changing to another vibration mode, thereby reducing the period of vibration.

In particular, as the vibration attenuating members 14 are disposed at both right and left portions 12*a* and 12*b* of the non-hole part 12, which is near the speakers, they attenuate the vibrations transmitted in the major axis direction (x-axis) that are apt to cause the howling phenomenon. Therefore, the vibration attenuating members 14 are capable of reducing the vibrations, for example sound waves transmitted from the speakers, which are the main vibration source, such that the variation of the beam-passing apertures 10*a* and degradation of the color purity due to the howling phenomenon may be effectively prevented.

It will be apparent to those skilled in the art that various modifications and variations can be made to the device of the present invention without departing from the spirit and scope of the invention. The present invention covers the modifications and variations of this invention provided they come within the scope of the appended claims and their equivalents.

What is claimed is:

1. A color selecting apparatus for a cathode-ray tube, comprising:

a frame; and a mask supported in the frame with tension in a direction of a minor axis, the mask comprising:

a rectangular hole part formed with a plurality of apertures passing electron beams;

a non-hole part surrounding the hole part, the non-hole part having no apertures passing electron beams; and a pair of vibration attenuating members attached at both ends of a surface of the non-hole part, the pair of vibration attenuating members facing each other in a direction of a major axis, the vibration attenuating members attenuating vibration waves transmitted along the major axis.

2. The color selecting apparatus of claim 1, with the vibration attenuating members being made of a nonmagnetic material different from the non-hole part.

3. The color selecting apparatus of claim 1, with the vibration attenuating members being made of a metal having a greater density than the non-hole part.

4. The color selecting apparatus of claim 3, with the vibration attenuating members being made of stainless steel.

5. The color selecting apparatus of claim 1, with the vibration attenuating members having a rod shape.

6. The color selecting apparatus of claim 5, with the vibration attenuating members being disposed in parallel with ends of the hole part.

7. The color selecting apparatus of claim 5, with the vibration attenuating members being made of equal length with facing ends of the hole part, the facing ends of the hole part facing the vibration attenuating members.

8. The color selecting apparatus of claim 5, with the vibration attenuating members being shorter in length than the facing ends of the hole part, the facing ends of the hole part facing the vibration attenuating members.

9. The color selecting apparatus of claim 1, with the vibration attenuating members being attached by welding points with the non-hole part, the vibration attenuating members separated from the non-hole part by a predetermined gap at every portion except at the welding points.

10. The color selecting apparatus of claim 1, with the vibration attenuating at members having a length corresponding to a length of a first section, the first section being a region degrading the quality of images through external vibration of the mask.

* * * * *